US011335158B2

(12) United States Patent
Pececnik et al.

(10) Patent No.: US 11,335,158 B2
(45) **Date of Patent: *May 17, 2022**

(54) ROTATING WHEEL SYSTEM

(71) Applicant: Interblock d.d., Menges (SI)

(72) Inventors: Joze Pececnik, Kamnik (SI); Urban Bergant, Kamnik (SI); Peter Kroselj, Kamnik (SI); Ivo Zavbi, Kamnik (SI)

(73) Assignee: INTERBLOCK D.D., Menges (SI)

( * ) Notice: Subject to any disclaimer, the term of this patent is extended or adjusted under 35 U.S.C. 154(b) by 6 days.

This patent is subject to a terminal disclaimer.

(21) Appl. No.: 17/025,251

(22) Filed: Sep. 18, 2020

(65) Prior Publication Data

US 2021/0005049 A1 Jan. 7, 2021

Related U.S. Application Data

(63) Continuation of application No. 16/365,210, filed on Mar. 26, 2019, now Pat. No. 10,803,699.

(60) Provisional application No. 62/648,232, filed on Mar. 26, 2018.

(51) Int. Cl.
*G07F 17/32* (2006.01)

(52) U.S. Cl.
CPC ..... *G07F 17/3213* (2013.01); *G07F 17/3227* (2013.01)

(58) Field of Classification Search
CPC .. G07F 17/3213; G07F 17/3227; A63F 5/045; A63F 5/046; A63F 5/0094
USPC ..... 463/31
See application file for complete search history.

(56) References Cited

U.S. PATENT DOCUMENTS

| | | | |
|---|---|---|---|
| 8,622,808 | B2 | 1/2014 | Pececnik et al. |
| 8,956,216 | B1 | 2/2015 | LeSourd et al. |
| 9,401,064 | B2 | 7/2016 | Young |
| 2006/0009278 | A1 | 1/2006 | Vancura |
| 2012/0115562 | A1 | 5/2012 | Kido et al. |
| 2012/0115563 | A1 | 5/2012 | Kido et al. |
| 2013/0281177 | A1 | 10/2013 | Pececnik et al. |
| 2014/0113698 | A1 | 4/2014 | Rakestraw et al. |

(Continued)

FOREIGN PATENT DOCUMENTS

WO WO 2015/107356 A1 7/2015

OTHER PUBLICATIONS

International Patent Application No. PCT/US2019/024078; Int'l Preliminary Report on Patentability; dated Jan. 27, 2020; 5 pages.

(Continued)

*Primary Examiner* — Allen Chan
(74) *Attorney, Agent, or Firm* — BakerHostetler

(57) ABSTRACT

A rotating wheel system includes face segments separated by posts positioned around a perimeter and a flexible pointer that interacts with the pegs as the wheel rotates. The system controls rotation of the wheel, randomly selects a segment at which to stop prior to the wheel being rotated based on a randomly selected friction deceleration and a randomly selected damping time constant, and controls rotation of the wheel to make it appear as though the wheel randomly stopped at the preselected segment. The system includes one or more player stations that are notified of the selected segment after the wheel is stopped. The system includes a second bonus wheel that is triggered when the selected segment is a trigger segment. The bonus wheel can be a physical wheel that is part of the wheel, a display that is part of the wheel, or displayed on a player station.

20 Claims, 8 Drawing Sheets

(56) References Cited

U.S. PATENT DOCUMENTS

| | | | |
|---|---|---|---|
| 2015/0011285 | A1 | 1/2015 | Kaiblinger et al. |
| 2017/0236382 | A1 | 8/2017 | Colvin et al. |

OTHER PUBLICATIONS

International Patent Application No. PCT/US2019/024078; Int'l Search Report and the Written Opinion; dated Jun. 19, 2019; 15 pages.

European Patent Application No. 19777326.0; Extended Search Report; dated Dec. 1, 2021; 8 pages.

ROTATING WHEEL SYSTEM

CROSS REFERENCE TO RELATED APPLICATIONS

This application is a continuation of U.S. patent application Ser. No. 16/365,210, filed Mar. 26, 2019, which claims benefit under 35 U.S.C. § 119(e) of Provisional U.S. patent application Ser. No. 62/648,232, filed Mar. 26, 2018, the contents of each of which are incorporated herein by reference in their entirety.

TECHNICAL FIELD

The present invention is related to rotating wheels for guessing and betting games.

BACKGROUND

A popular device used in many games of chance is a large rotating wheel. In one type of game, called a "Big Wheel," the face of the game wheel is divided into a number of equally separated segments, each of which is associated with a symbol, such as a number or image. Pegs positioned near the edge of the face stick out from the face of the game wheel and indicate a separation between segments. The game wheel is mounted in a support structure that provides physical support for the game wheel and houses power and controller equipment for the game wheel and the game. A flexible pointer at the top of the game wheel structure indicates the current position of the game wheel. Players bet on whether the game wheel will stop on a particular symbol corresponding to a segment. When the game wheel is rotated at sufficient velocity, the force of the pegs of the game wheel will overcome the resistance of the flexible pointer, which will then bend as each peg passes, until the wheel has decelerated to a point where there is insufficient velocity and/or force to enable a peg to pass by the flexible pointer, at which point the game wheel will stop at a segment, indicating the conclusion of the game.

Traditionally, the game wheel of the wheel system would be spun by an operator, such as a dealer at a casino, who would also be responsible for accepting bets by players, spinning the game wheel, announcing the result, collecting lost bets and paying out won bets. A fully automated wheel system that allows players to place bets and spin the game wheel, while electronically handling payments and payouts is desirable because it eliminates the cost of the dealer and the potential for any collusion between a player and a dealer to rig the game. However, for a fully automated wheel system to be acceptable to licensing authorities in many jurisdictions around the world, the game has to have a controlled random outcome. The game also has to look, sound and operate like the traditional game or players may not be attracted to playing the game, or may not like how it looks, sounds and/or operates.

SUMMARY

A rotating wheel system is described that includes a game wheel having at least an outer face on a plane segmented into a predetermined number of distributed pie-shaped segments. The game wheel is supported by a support structure. A division between each segment is indicated by a peg that is affixed to the face near the perimeter of the face and orthogonal to the plane of the face. A pointer supported by the support structure is positioned at the top of the outer face and configured to engage the peg. The pointer is configured to flex when a peg engages the pointer with sufficient force. The wheel system includes a central pulley that is driven by a motor with a belt. A controller controls the motor to precisely position the game wheel relative to the pointer at all times. During game play, the game wheel is spun by the motor via the belt, thereby causing the pointer to engage the pegs as the game wheel spins. Before the game wheel is spun, a random number generator selects one predetermined randomly generated segment among the plurality of segments at which the pointer will make a controlled stop, thereby commencing the game. Upon being spun by the motor, the game wheel accelerates for a predetermined period of time, maintains a predetermined velocity for a predetermined period of time, then decelerates for a predetermined period of time until the pointer reaches the predetermined segment just as the game wheel appears to have run out of velocity sufficient for continued movement. Deceleration of the game wheel to a controlled stop at the predetermined segment is controlled by preselecting a friction deceleration and a damping time constant.

A user may also be allowed, through a user interface device, to send a stoppage signal to the controller of the motor, thereby giving the user the impression of control over the game. However, the user's stop signal does not actually cause the game wheel to stop at any segment other than the predetermined segment. Rather, the stoppage signal simply indicates to the controller that it should begin to simulate the appearance of the game wheel slowing prior to stopping at the predetermined segment. Additional movement of the game wheel once the predetermined segment has been reached simulates the appearance of the predetermined segment being selected by chance. Additional movement includes slightly moving the game wheel forward and backward when the pointer is between the pegs of the predetermined segment without passing either peg and just passing a peg so as to reach the predetermined segment. Motion detectors detect the acceleration, velocity and deceleration of the pegs during game play and generate motion signals to a sound generator that generates sound simulating the sound of the pointer hitting the pegs and the wheel rotating. Coordinated illumination and sounds highlight the predetermined segment once the pointer has stopped on the predetermined segment. The game wheel may also include the outer face for the primary game, and a second wheel or face for a bonus game. If the predetermined segment is a bonus segment, when the pointer has stopped at the bonus segment, the inner wheel or face may be spun as part of a bonus round.

DETAILED DESCRIPTION OF ILLUSTRATIVE EMBODIMENTS

Figure 1:
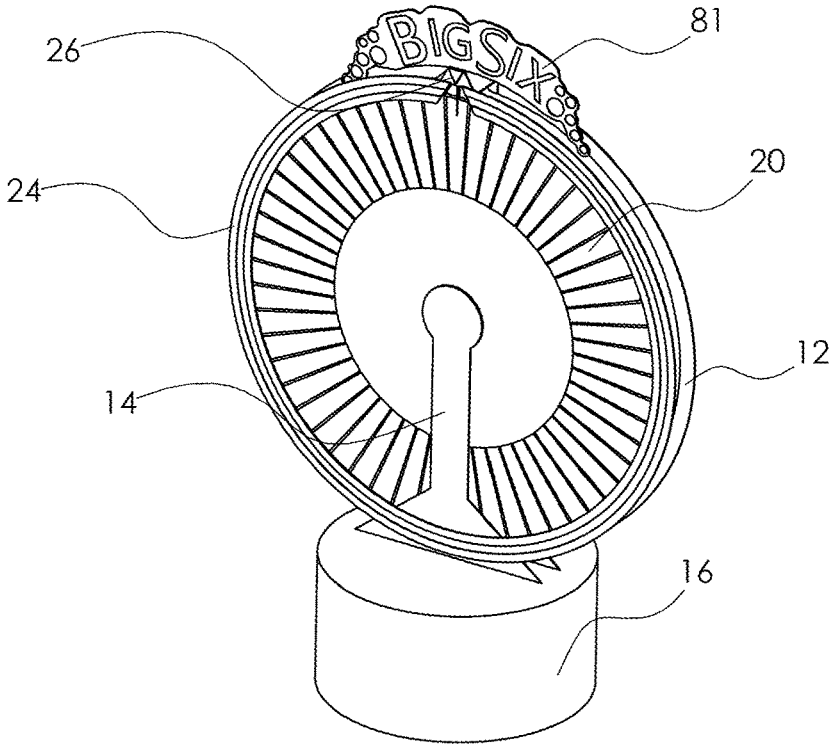
FIG. 1 is a perspective illustration of a game wheel and its support structure.
Figure 2:
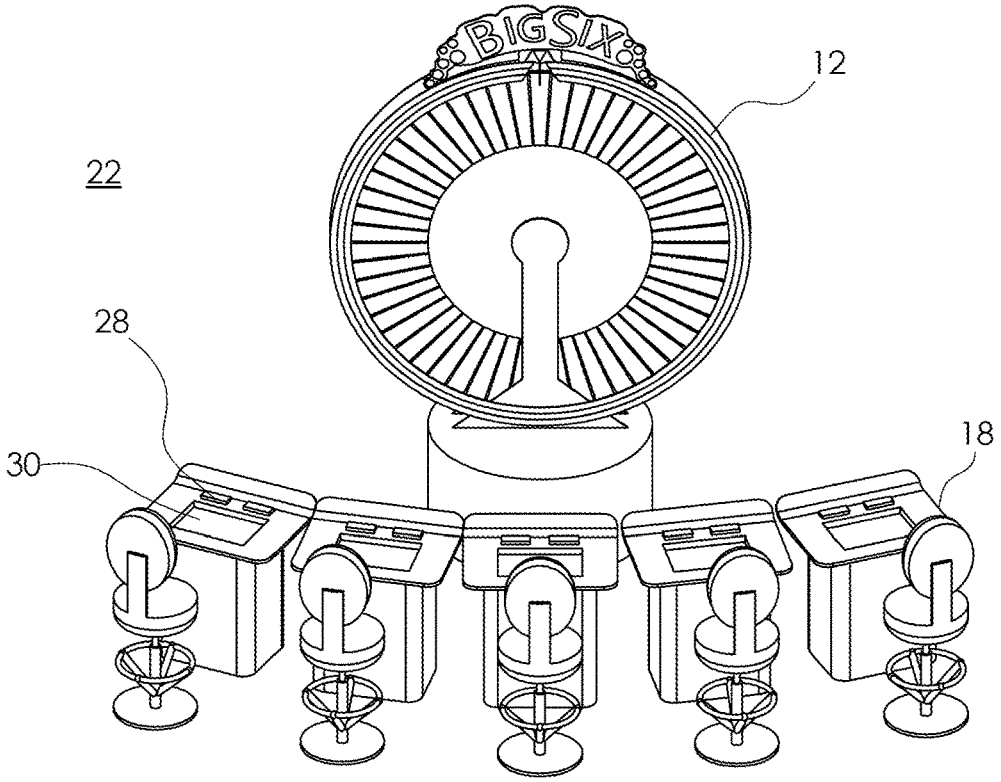
FIG. 2 is a perspective illustration of the wheel system, including the game wheel of FIG. 1 connected to five play stations.

FIG. 1 illustrates a game wheel 12, a support structure 14, and a controller housing 16. As shown in FIG. 2, those components may then be associated with a number of physical play stations 18 to create the wheel system 22. Each play station 18 may include a seat and a player interface system that may allow players to view their betting options, input money or credits, place bets, monitor game action, and receive payouts.

The game wheel 12 shown in FIG. 1 and FIG. 2 is about 2 meters in diameter, although any other size of game wheel is possible without departing from the basic disclosure herein. The game wheel 12 is also double-sided with an outer face 24 and a flexible pointer 26 on each side, although only one side is illustrated in FIG. 1 and FIG. 2. Single-sided game wheels may also be used in place of double-sided game wheels. Separate sets of play stations 18 may be positioned on either side of the Big Wheel and the face of each side of the game wheel 12 may be the same or different. Each face may be associated with its own wheel that may spin independent of the face and wheel on the opposite side, or a single wheel may be associated with both faces.

As illustrated, the game wheel 12 may be divided into 52 or 54 segments 20, although different sized game wheels could have more or less segments 20, and even the game wheel 12 illustrated could be divided differently. Each segment 20 may be associated with a symbol, such as a graphic illustration, a number(s), letter(s), color(s), word(s), illumination(s), etc., so as to distinguish at least one segment 20 from another segment 20. As more clearly illustrated in FIG. 9, each segment 20 is separated by a peg 23 that interacts with a flexible pointer 26. Generally, the pegs 23 are formed of metal or some other suitable material and are affixed to the outer face 24 of the game wheel 12 so they will remain fixed to the outer face 24 as the game wheel 12 is spun and as the pegs 23 interact with the pointer 26. The segments 20 of the outer face 24 may be pie-shaped so that they are wider at the perimeter of the outer face 24 and narrower at the center of the outer face 24.

As the outcome of each game must be randomly determined in a secure and repeatable manner, and because the segment 20 at which the pointer 26 will stop at the end of the game is predetermined, it is desirable to be able to control the start, rotation and stop of the game wheel 12 with great accuracy. At the same time, it is also desirable to give players the impression that the game is more like a traditional Big Wheel, where the game wheel 12 and pointer 26 stop at a segment 20 by pure chance as a result of the manner and force the dealer used to spin the game wheel 12, the friction of the wheel mechanism and the friction of the pegs 23. It is also desirable to give players the impression that their interaction with the wheel system is somehow responsible for its operation and the segment 20 at which it stops, which adds to the attractiveness of the game from the player's perspective. Accordingly, one method of permitting the player to interact with the game is to give the player the impression that they are spinning the wheel and therefore, deciding what segment 20 will ultimately be pointed to by the pointer 26 when the game wheel 12 stops. The player does not actually have anything to do with the segment 20 that is selected by the random number generator of the controller for the wheel system, but allowing the player to start play gives the player the sense of control, luck and interaction. However, allowing the player to start play also introduces the potential for delay, while the player decides what they want to do and when they want to hit the button or pull the lever that appears to give the impression of starting play. Generally, if the player does not start play soon enough, the wheel system may be programmed to start on its own, but the delay before this happens can slow down overall game play, which reduces the potential for revenue generation from the game.

In an embodiment disclosed herein, once all of the bets have been placed and betting has been closed (which may be set as a predetermined time from the start of rotation of the game wheel 12), a player is given the option of stopping play by pressing a button 28 on their play station 18. The button 28 may be a user interface element, which may be known in the art, displayed on a touch sensitive screen of the display screen of the play station 18. Which player gets to stop play may be randomly determined or determined according to some predetermined sequence. The player selected to stop the game wheel 12 may also be the player that has placed the biggest bet during the current game, which has the added advantage of encouraging more betting.

If the player does not press the button 28 within a predetermined period of time, the game wheel 12 may be programmed to indicate it is stopping on its own. Instead of a user interface element button 28, the player may alternatively use a control pad or physical control device 30 built into the play station 18. The control device 30 may be able to sense the presence of a player's hand over the control device 30, gestures of the player on the surface of or above the control device 30, the touch and/or pressure of a player's touch on a surface of the control device 30, or other types of actions that indicate the player's desire to the controller of the game wheel 12. Regardless of the manner in which the player is enabled to indicate a stop of the game wheel 12 has been initiated, the game wheel will appear to begin to stop either immediately or shortly after stop initiation.

Figure 3:
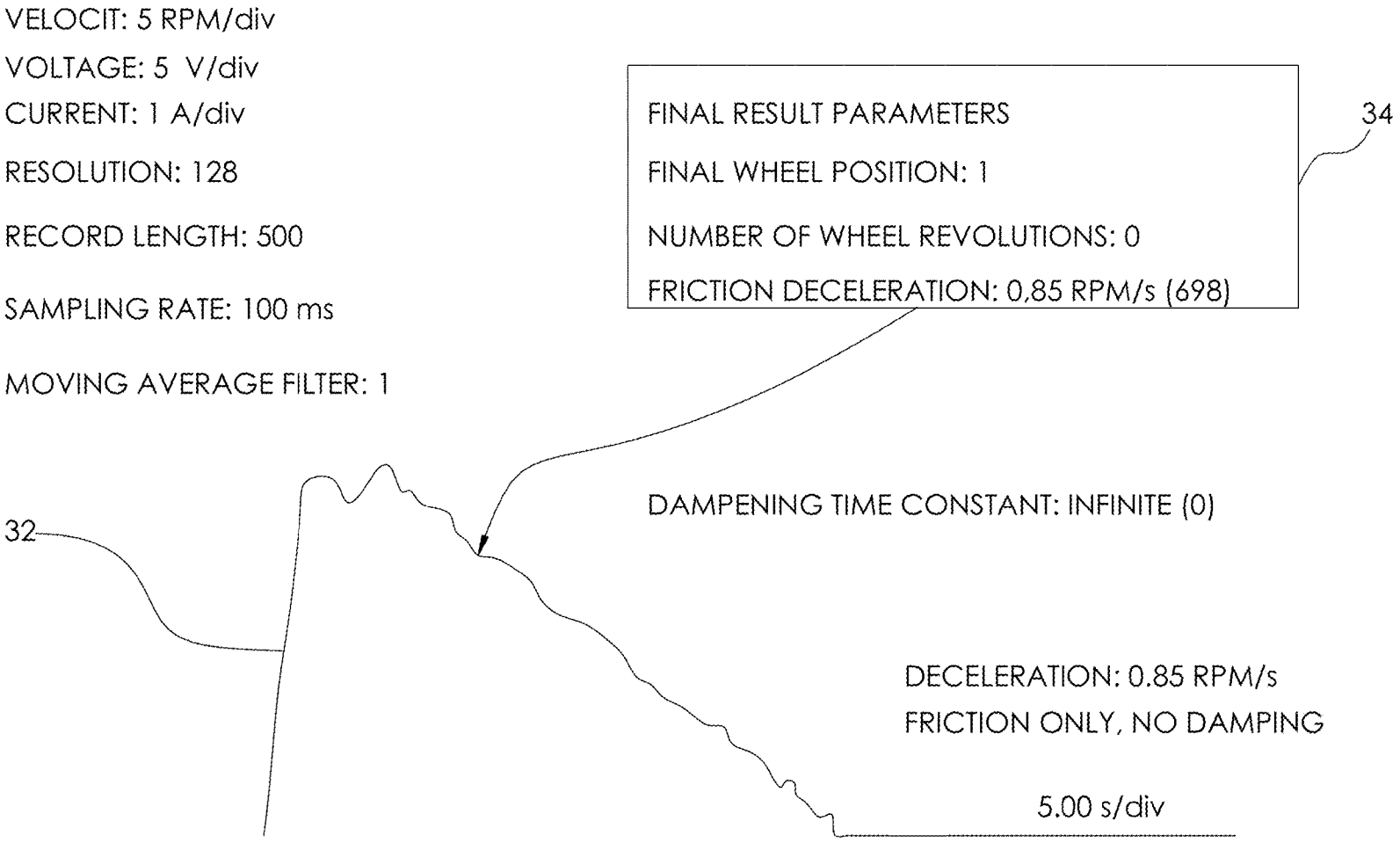
FIG. 3 is a graphic illustration of how friction alone will slow and eventually stop the game wheel.

Braking and stopping the game wheel 12 exactly at a predetermined randomly selected segment 20 may involve at least two factors: friction and damping. The force of friction does not depend on game wheel speed, i.e., it is constant. If friction was the only force braking the game wheel 12, the game wheel speed would decrease linearly with fairly constant deceleration, which is illustrated by the descending line in FIG. 3. FIG. 3 shows a computer interface outputting a graph 32 and other information illustrating a game wheel's speed or velocity over time as only friction is applied to the game wheel 12. The control panel 34 illustrates that only friction deceleration of 0.85 revolutions per minute (RPM) is being applied to the wheel, which results in the fairly controlled braking and stoppage of the game wheel.

Figure 4:
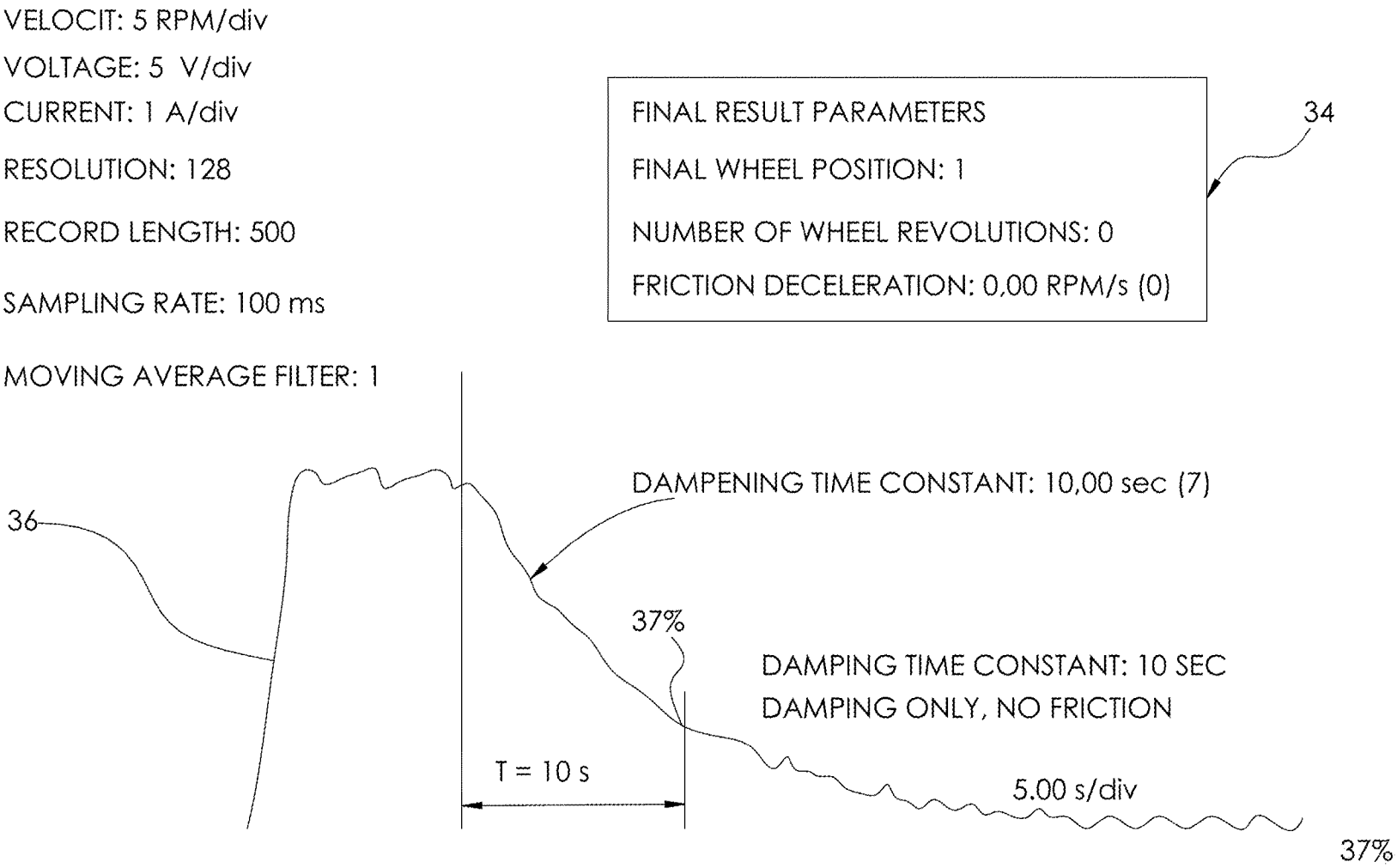
FIG. 4 is a graphic illustration of how damping alone will slow and eventually stop the game wheel.

The force of damping, however, linearly depends on game wheel speed—the higher the speed, the larger the braking force. If damping was the only force braking the game wheel, the game wheel speed would decrease exponentially, as follows:

$$v(t)=v_0e^{-t/\tau},$$

where the rate of braking (in case of exponential stopping), as defined by the damping time constant $\tau$ and time t, is the interval in which the speed falls to the value of 1/e, or to 37% of its initial value. Theoretically, according to the formula, the game wheel never stops, i.e., the speed simply approaches the zero value. This is illustrated in FIG. 4, which shows a computer interface outputting a graph 36 illustrating a game wheel's speed or velocity over time as only damping (and no additional friction) is applied to the game wheel 12. The control panel 34 illustrates that only damping is applied at a time constant of 10 seconds.

At high game wheel speeds, damping is the dominant force because the damping force is much higher than the friction force. As the speed of the game wheel decreases, friction becomes more important and at the end of the braking function, friction is the only force that is required to actually stop the game wheel 12.

Figure 5:
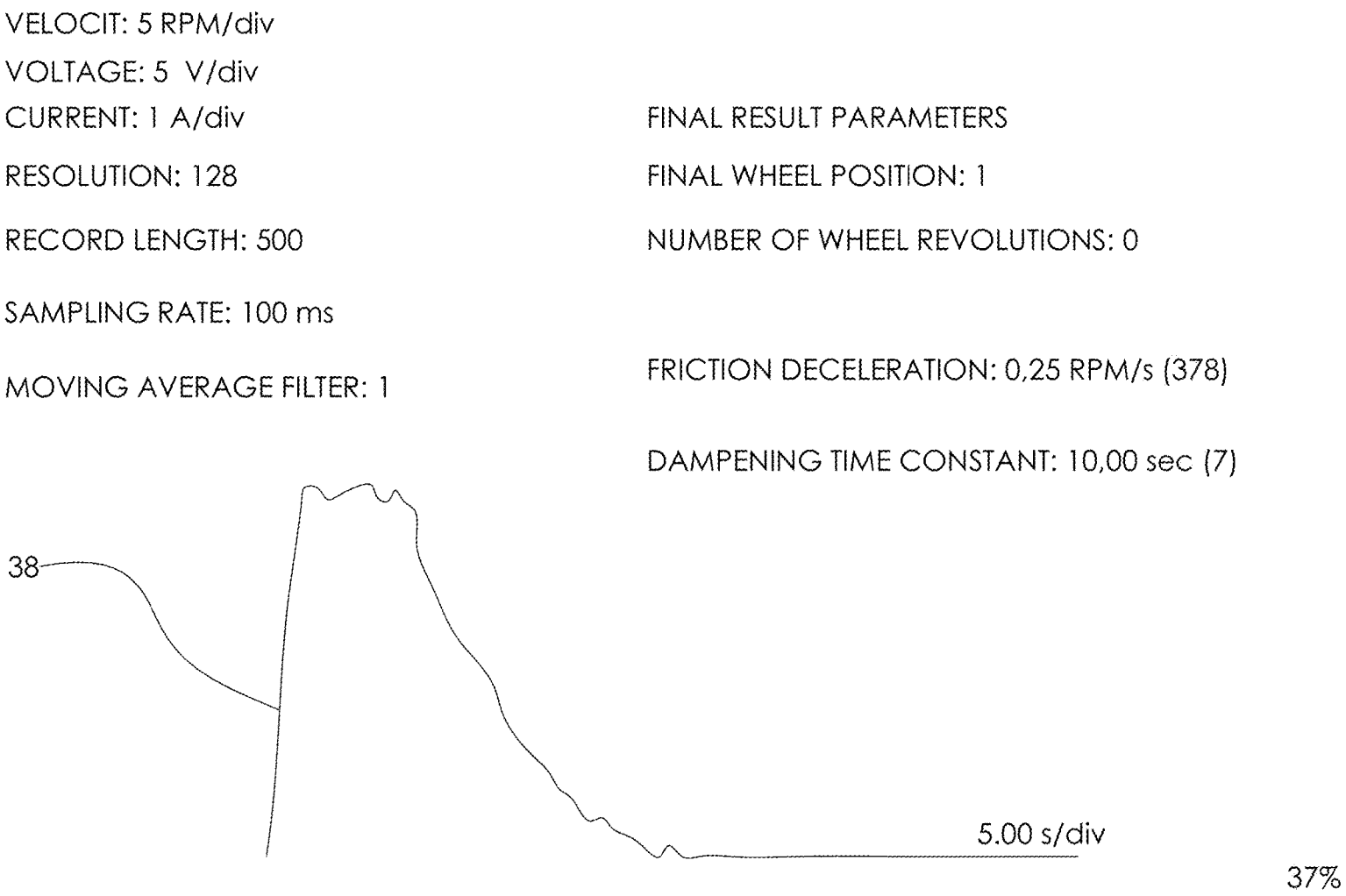
FIG. 5 is a graphic illustration of how a combination of friction and damping can be used to control the operation and stopping point of the game wheel.

To realistically simulate a game wheel slowing and stopping, both friction and damping may be utilized in appropriate proportions, which are referred to as the parameters of "Friction Deceleration" and "Damping Time Constant." Both parameters are randomly selected within a predefined range by the wheel system's gaming control software on a game by game basis, as part of the random number generation function. Each game, therefore, has a slightly different velocity over time curve associated with wheel stoppage, which is illustrated in FIG. 5, which shows a computer interface outputting a graph 38 illustrating a game wheel's speed or velocity over time as both friction and damping are applied to the game wheel 12. In order to realistically stop the game wheel at the randomly selected, but specified position, exactly, there are at least two possible options that may be selected by settings of the game controller software: (1) normal game wheel stoppage, and (2) immediate game wheel stoppage.

Under normal game wheel stoppage, the game controller software receives a command to stop the wheel from either a play station 18, or by default by the controller software. The parameter of this command is the desired final position, i.e., the result. According to this setting, the braking process is not started immediately; rather, the controller software waits for the optimal game wheel position (the "optimal start braking position") to arrive before starting the process of stopping the wheel at the desired final position. The difference between the desired final position and optimal start braking position is called the "braking angle." The braking angle is a function of the current game wheel speed and game wheel stopping parameters (i.e., friction and damping). The time period from the moment the stop command is received to the moment when the braking process is initiated is called the "extended rotation." Normal game wheel stoppage may be the default mode when players do not have the option of appearing to stop the game wheel 12.

Under immediate game wheel stoppage, the braking process starts immediately after receiving the stop command. In order to stop the game wheel at the desired final position, the stopping parameters must be adjusted to account for the lack of extended rotation. Immediate game wheel stoppage operation mode may be used when a player does have the option of appearing to stop the game wheel 12 by pressing the button 28, or otherwise indicating a stop through control device 30. If the player does not initiate a stop, the normal game wheel stoppage may be used. As will be further described below, additional game wheel stoppage processes may be utilized to make the game wheel stoppage process appear even more realistic to observers, but has not actually outcome on the result.

Figure 6:
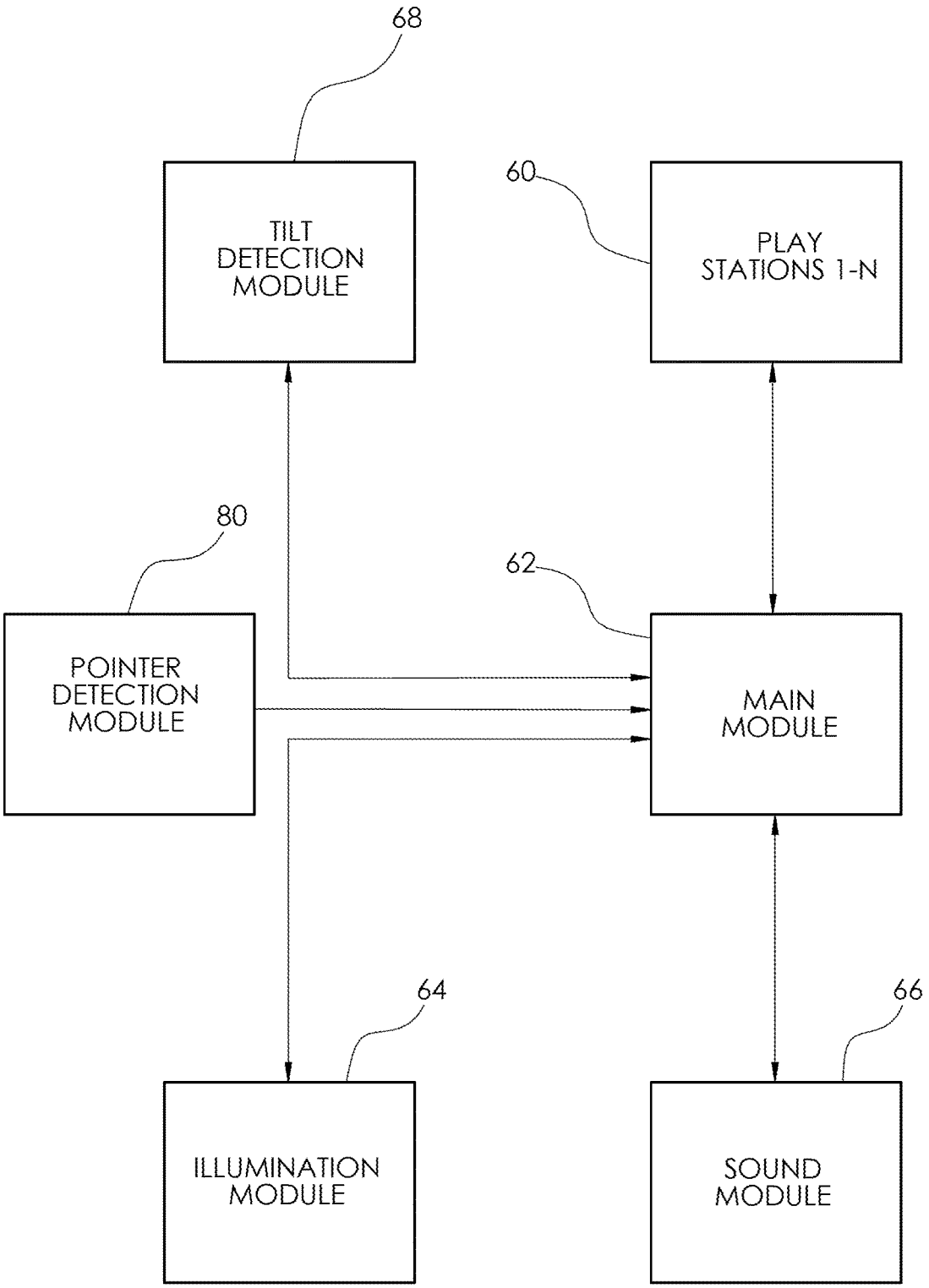
FIG. 6 is a schematic illustration of the mechanical and electronic subsystems of the game wheel and the play stations connected to the wheel system's main module.

FIG. 6 provides a basic schematic diagram for the mechanical and electrical components of the wheel system and the associated play stations 1-N 60, which are connected electrically to the main module 62 of the wheel system 22. The main module 62, the illumination module 64, and the sound module 66 may each be housed in the controller housing 16, which may also include a main motor, an electrical cabinet (including the main module 62, the illumination module 64 and the sound module 66), controller software and power, such as 115/230 volt. The controller housing 16 may include a number of wheels so that the wheel system may be readily moved from one position to another on the floor of a facility, or for delivery or maintenance. Adjustable feet may also be included to stabilize the wheel system 22 at a desired location and to make it more difficult for the wheel system to be moved or tilted.

A tilt detection module 68, as is known in the art, may also be included in the housing 16, such as a device that measures any change in the orientation of the housing 16 in two or three dimensions, and therefore the game wheel 12, which might be caused by a player pushing on the housing 16 in an attempt to change the outcome of the game. If a tilt is detected by the tilt detection module 68, a tilt signal may be sent to the controller software or the main module 62 and the game may be immediately terminated. A signal indicating that a tilt has occurred may also be communicated to a central server or security server so that casino management and/or security are aware of the tilt activation.

Figure 7:
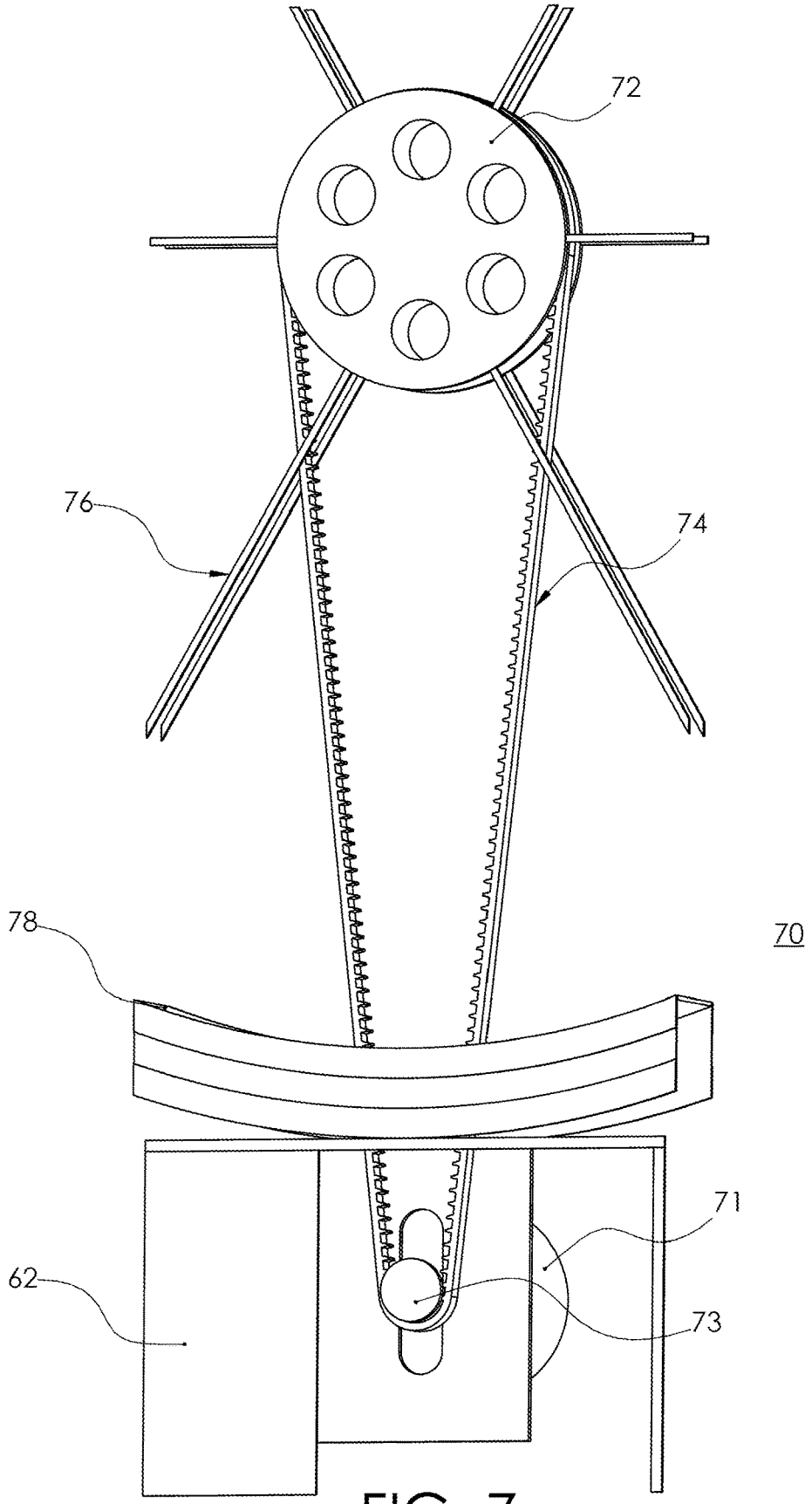
FIG. 7 is an illustration of the wheel spinning mechanism of the wheel system.

The main module 62 may regulate the drive system 70 (further illustrated in FIG. 7) and control the game cycle, hence main module 62 includes the drive system 70, a microprocessor, memory and the controller software necessary to control the drive system 70, communicate with the other modules 64, 66 and 68 and the play stations 18, and perform any other necessary functions for operation of the wheel system. The drive system 70 may include any suitable motor given the size of the game wheel to be rotated. For the 2 meter wheel illustrated herein, with two opposing faces, the main motor has a nominal torque of 0.7 Nm, a maximal torque of 2.1 Nm and a nominal speed of 3000 RPM. The main motor 71 includes a small pulley 73 that is connected by a drive belt 74 to a central pulley 72 of the game wheel 12. The drive belt 74 may be a toothed, notched, cog or synchronous belt, or other form of positive transfer (i.e., timing) belt that enables tracking of relative movement so the rotation of the game wheel 12 may be precisely controlled. Other types of belts may also be used as appropriate. The pulleys 72 and 73 would vary accordingly to match the type of drive belt 74 utilized. An incremental optical encoder (not shown) may also be used to track and verify movement of the belt 74, and therefore movement of the game wheel 12. The central pulley 72 may be connected by a number of spokes 76 on one end and a rim 78 of the game wheel 12 on the other end. The spokes 76 and rim 78 are split so as to permit travel of the belt 74 between the spokes 76 and the open split between the rim 78.

Through use of a closed loop feedback system that measures the intended (i.e., theoretical) movement against the actual movement and then makes continual adjustments as needed, such as tightening the tension on the belt 74 through a tensioner (not shown), if there is error between the theoretical and actual. For example, the theoretical movement would be predetermined by the main module 62 and then the actual movement could be measured by the optical encoder and feed back to the main module 62 so any necessary adjustments could be made.

A further aspect of the precise control of the game wheel 12 is that it enables additional precise movements of the game wheel 12 that further help to simulate the actual non-controlled spin of the game wheel 12. For example, with a traditional wheel, the pointer 26 may occasionally, toward the end of the spin, hit a peg 23 and not have sufficient velocity to pass the peg 23. As a result, the wheel almost moves from one segment 20 to another and then reverses direction and bounce between the two pegs 23 delineating the chosen segment 20. Alternatively, sometimes the pointer 26 of the game wheel 12 will hit a peg 23 and appear to not be able to pass the peg 23, and then just tip passed it to enter the next segment 20.

Both of these actions can be simulated through careful control of the game wheel 12 through the main motor 71 and drive belt 74. For example, if the randomly selected segment corresponds to the symbol "13," the game wheel 12 can be controlled such that the pointer 26 stops precisely in the middle of the segment for symbol 13 or almost pass that segment and then bounce back into it, by simply advancing the wheel until the peg 23 is contacted sufficiently and then reversing direction a bit to make the game wheel 12 appear to bounce back. This simulation can be taken a bit further by having the wheel reverse until it contacts the prior peg 23 and then advance again to settle in the middle of the segment of symbol 13. Alternatively, the game wheel 12 can be controlled so that the pointer 26 just passes a peg 23 before it settles in the next segment 20, again ending up exactly where it was intended to end up, but simulating what appears to be more natural movement.

The illumination module 64 may include a number of independent output channels for controlling a corresponding number of LED segments. The number of output channels depends on the size of the game wheel and the desired amount of lighting and its location. Illumination and lighting color can be controlled by the illumination module 64 to work in coordination with the main module so that illumination matches the status of each game, such as before and during the start of each game, the bet placement period, the bet close, game stoppage (as further indicated below), game payout, etc. As further described below, the sound module 66 generates sound that matches the movement of the game wheel 12 and the interaction between the pointer 26 and the pegs 23, so as to create a realistic game environment. The sound module 66, like the illumination module 64, may also be coordinated with the main module so that sound matches the status of each game.

Figure 8:
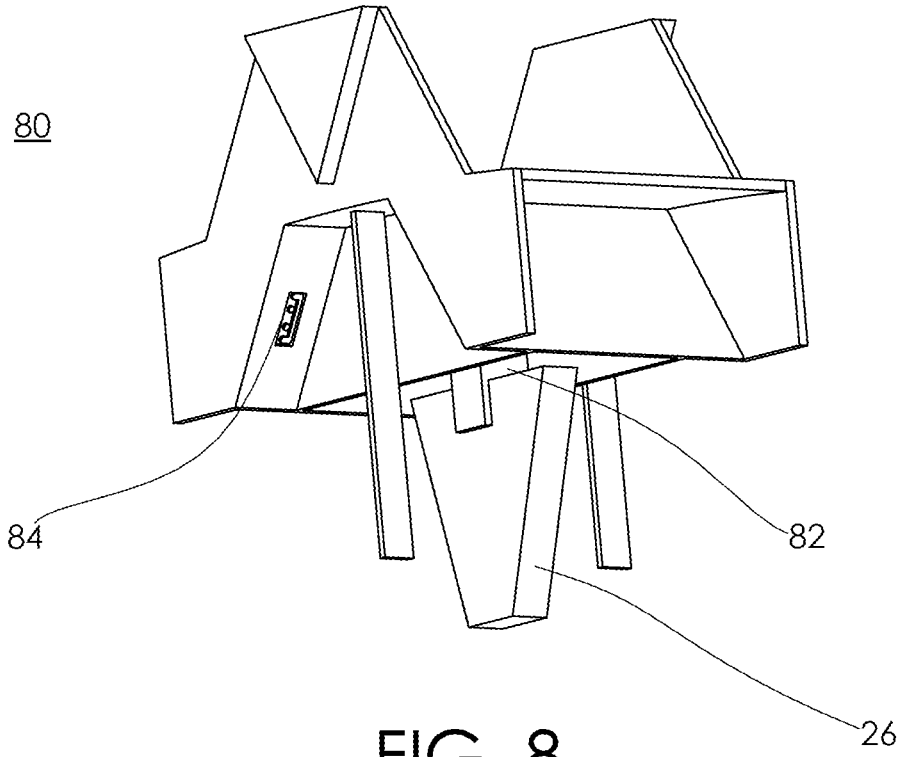
FIG. 8 is an illustration of the pointer detection module of the wheel system.

Although not clearly illustrated in FIGS. 1 and 2, both outer faces 24 of the game wheel 12 are covered with a clear dimensional material to protect the outer faces 24 and to prevent tampering with the game. As a result of that, however, the sound that would normally be generated by the game wheel 12 spinning and the pointer 26 engaging the pegs 23 as it goes around may be too muted to be heard by players; players like to hear the traditional sound of the game as part of the gaming experience. As with the motion of the game wheel 12 itself, the proper sound of the wheel system can also be simulated. To generate the desired sounds, the housing 16 includes a pointer detection module 80 that is connected to the main module 62. The pointer detection module 80 may be physically mounted in the housing behind the "BIG SIX" sign 81 at the top of the game wheel 12, as shown in FIG. 1. The pointer detection module 80 is more fully illustrated in FIG. 8. The pointer 26 is made of a durable material that can hit the pegs 23 repeatedly over many thousands of game plays without degradation or deformation. Rather than be made of a flexible material itself, which might give the game less control, the pointer 26 is made of a firm material, with the flexibility of the pointer 26 being generated by a flex mechanism 82 that enables the pointer 26 to bend in two opposite directions when the pointer 26 hits a peg 23. Further control can be exerted over the segment selected by the pointer 26 by braking the flex mechanism 82 when necessary to prevent it from passing a peg 23.

On either side (i.e., left and right) of each pointer 26 (the game wheel 12 has two faces and therefore two pointers on either side), there are two independent motion detectors 84 that monitor the movement of the pegs 23 as they pass by. When the game wheel 12 is first spun, the pegs 23 accelerate briefly, then reach a certain velocity which is maintained until the game stop command is received, and then begin to decelerate either as a result of normal game wheel stoppage mode, or immediate game wheel stoppage mode, until the game wheel 12 stops at the pre-determined segment 20, which may or may not include other simulated affects, such as just passing a peg 23 or bouncing between pegs 23, etc. The motion detected by the motion detectors 84 is then fed to the sound generator circuitry of the sound module 66, which generates the simulated sound of each pointer 26 when it hits the pegs 23 based on the acceleration, velocity and deceleration of the game wheel 12 so that the sound matches up to what the players are seeing and would expect to hear if they could actually hear the physical components of the wheel system interacting. The same can be done at the stopping point where the pointer 26 may hit a peg 23 and bounce back, or just pass a peg 23, with appropriate sound being generated at the time either simulated event is occurring.

Figure 9:
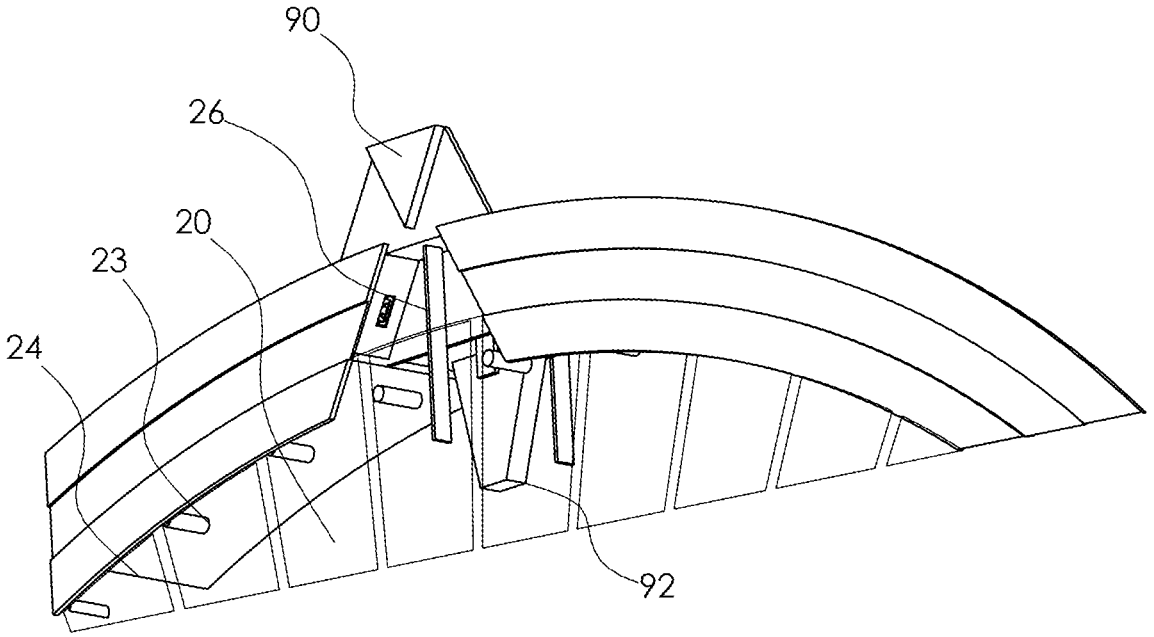
FIG. 9 is a further illustration of the pointer and pegs and illustrates how results of a game are indicated on the wheel system.

The illumination aspects controlled by the illumination module 64 are further illustrated in FIG. 9. In addition to other lighting that is provided on the game wheel 12 or around the support structure 14, further illumination may be provided to indicate the result of the spin. For example, the triangle 90 positioned above the pointer 26 can be illuminated, such as in bright red, when the pointer 26 has stopped on a segment 20 corresponding to a pre-determined symbol. The pointer 26 can likewise be illuminated, also in red, and a LED spotlight 92 positioned behind the outer face 24 of the game wheel 12 can be illuminated in white, so as to highlight the selected segment 20. Sound may also be played by the sound module 66 when the result lighting is activated to draw attention to the result.

Figure 10:
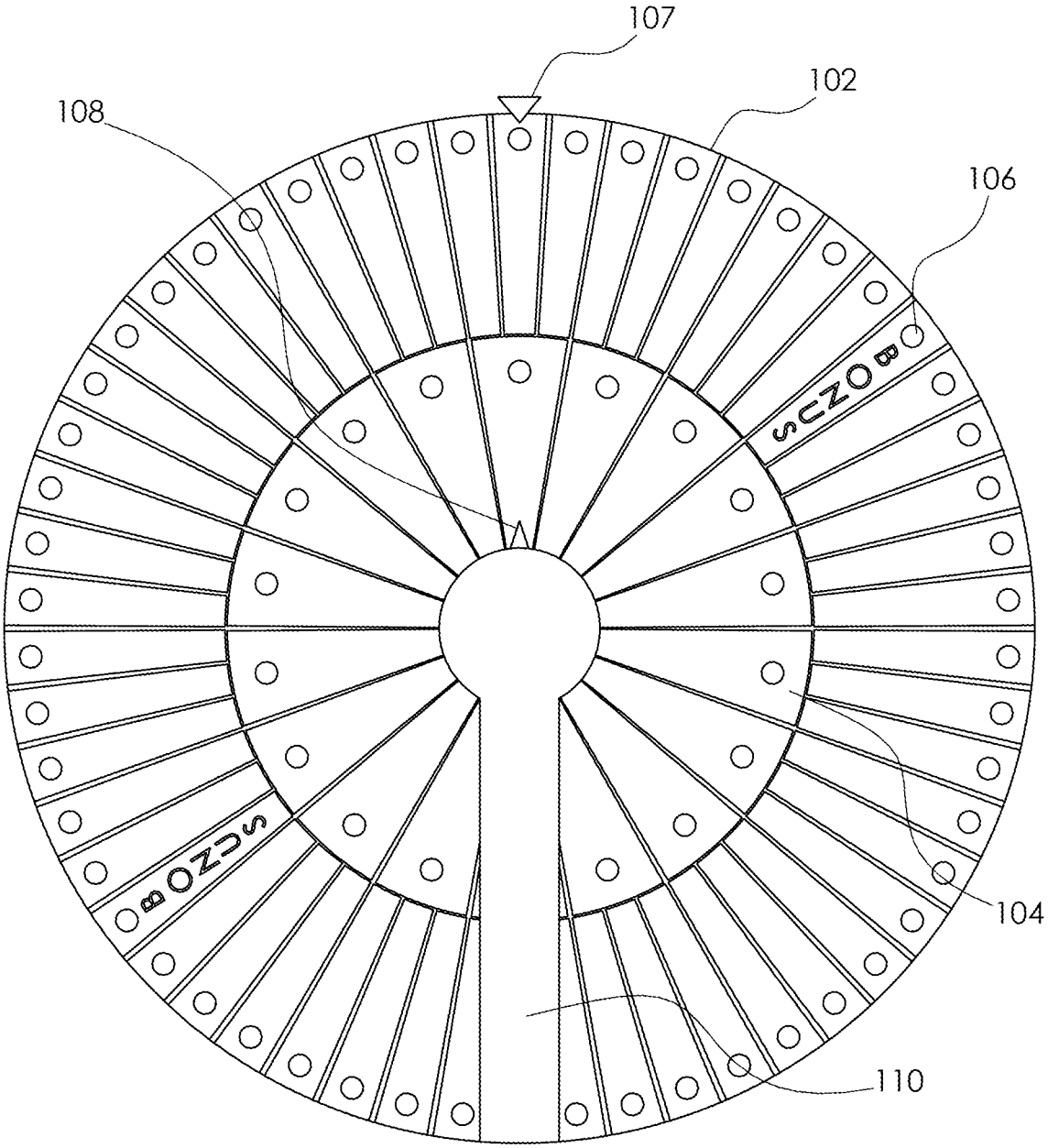
FIG. 10 is a front view of an embodiment of a game wheel with a separate mechanical or video bonus wheel.

FIG. 10 illustrates two bonus wheel embodiments of wheel system 100. In a first embodiment, there are actually two physical wheels, controlled in the same manner as game wheel 12, an outer wheel 102 and an inner wheel 104. The outer wheel 102 includes one or more bonus segments 106 among the plurality of segments. If pointer 107 of the outer wheel 102 stops at one of the bonus segments 106 as the result, the inner wheel 104 would then be activated or triggered as a bonus round of play that is not otherwise normally available. The inner wheel 104 would operate in substantially the same manner as outer wheel 102 in terms of its random segment selection, control, sound, illumination, etc., but the pointer 108 may be positioned on the support structure 110 and pointed upward, instead of downward like pointer 107. The plurality of segments of inner wheel 104 may correspond to other payout options. In the second embodiment, the inner wheel 104 is not a physical wheel-like outer wheel 102, but is rather a virtual wheel displayed on a circular display. Alternatively, the bonus wheel may not be a physical part of wheel system 100 at all, but rather just a virtual display of a wheel on the display screen of the play station 18. Bonus awards/prizes generated as a result of the bonus wheel may be variable.

Having thus described the different embodiments of a wheel system and methods of controlling the same, it should be apparent to those skilled in the art that certain advantages of the described methods and apparatuses have been achieved. In particular, it should be appreciated by those skilled in the art that the main module can be assembled using standard microprocessing hardware and software and combinations thereof. It should also be appreciated that various modifications, adaptations, and alternative embodiments thereof may be made within the scope and spirit of the present disclosure.

What is claimed:

1. A rotating wheel system, comprising:

a rotating wheel including a face separated into a plurality of segments and a plurality of pegs positioned around the face, wherein each peg denotes a physical separation between segments;

a main control module including a drive system configured to control rotation of the rotating wheel including rotation above, at or below a predetermined velocity; and a pointer configured to allow a peg to pass by the pointer when the rotating wheel is at or above the predetermined velocity and to not pass the pointer when the rotating wheel is below the predetermined velocity, wherein the pointer is configured to stop at a randomly predetermined segment when the main control module determines the rotating wheel should stop rotating based on one or more rotating wheel stopping parameters including a randomly selected friction deceleration and a randomly selected damping time constant.

2. The system of claim 1, wherein the rotating wheel begins spinning upon an activation of at least one of a button, a lever, and the rotating wheel.

3. The system of claim 1, wherein the main control module initiates the rotation of the rotating wheel at a predetermined time before or after a gaming event.

4. The system of claim 3, wherein the gaming event is one or more of: a time when betting is closed, a player or dealer interaction with a user interface element, and an absence of player interaction with the user interface element.

5. The system of claim 1, wherein the main control module is further configured to execute one or more rotating wheel stoppage settings.

6. The system of claim 5, wherein in a normal wheel stoppage setting, upon receiving a stop command, the main control module determines an optimal game wheel position to start braking, a desired final rotating wheel position, and brakes the rotating wheel over a time period based on the randomly selected friction deceleration and damping time constant.

7. The system of claim 5, wherein in an immediate wheel stoppage setting, upon receiving a stop command, the main control module initiates braking prior to an optimal game wheel position to start braking, and adjusts the stopping parameters to stop at a desired final rotating wheel position.

8. The rotating system of claim 1, further comprising a control device for user gameplay interaction, wherein the control device can detect one or more of: a presence of a hand or object over the control device, a gesture on a surface of or above the control device, a touch on the surface of the control device, a gesture above the surface.

9. The system of claim 1, further comprising a tilt detection module measuring a change in orientation of the rotating wheel.

10. The system of claim 1, wherein the tilt detection module is configured to send a signal to at least one of the main module, a server, and an external device upon detecting a change in orientation.

11. The system of claim 1, further comprising a second rotating wheel operated by the main control module, configured to rotate at, above or below a second predetermined velocity, and stop based on one or more rotating wheel stopping parameters.

12. The system of claim 11, wherein the second rotating wheel is activated in a bonus round.

13. The system of claim 11, wherein the second rotating wheel is a physical wheel mounted with the rotating spin wheel, or a virtual wheel displayed on a display.

14. The system of claim 1, wherein the rotating wheel is a single-sided wheel or a double-sided wheel, wherein on the double-sided wheel, the face of each rotating wheel is identical or different and each wheel on the double-sided wheel can spin jointly and/or independently.

15. The rotating wheel system of claim 1, further comprising: one or more player stations for interacting with the main control module, wherein the main control module is configured to notify the one or more player stations of the randomly predetermined segment after the rotating wheel is stopped at the randomly predetermined segment.

16. The system of claim 1, further comprising a pointer detector configured to detect motion of the rotating wheel in order to identify each segment among the plurality of segments that corresponds to the location of the pointer as the rotating wheel rotates.

17. The system of claim 1, wherein the drive system includes a motor, a first pulley connected to the motor, a second pulley connected to the rotating wheel, and a belt connected to the first pulley and the second pulley and configured to transfer rotational power from the motor that rotates the first pulley to the second pulley that rotates the rotating wheel in a first direction and a second direction.

18. A method of operating a rotating wheel system comprising:

rotating a first wheel, including a face separated into a plurality of segments and a plurality of pegs positioned around the face, wherein each peg denotes a physical separation between segments;

controlling rotation of the first wheel to allow a peg to pass by the pointer when the first wheel is at or above the predetermined velocity and to not pass the pointer when the first wheel is below the predetermined velocity; and stopping rotation of the first wheel at a randomly predetermined segment when the main control module determines the first wheel should stop rotating based on one or more rotating wheel stopping parameters including a randomly selected friction deceleration and a randomly selected damping time constant.

19. The method of claim 18, further comprising:

upon receiving a stop command indicative of a normal wheel stoppage setting, determining an optimal game wheel position to start braking, a desired final rotating wheel position, and braking the rotating wheel over a time period based on the randomly selected friction deceleration and damping time constant; and upon receiving a stop command indicative of an immediate stoppage setting, the main control module initiates braking prior to an optimal game wheel position to start braking, and adjusting the stopping parameters to stop at a desired final rotating wheel position.

20. The method of claim 18, further comprising:

rotating a second wheel at or above a second predetermined velocity; and stopping the second wheel based on one or more rotating wheel stopping settings.

* * * * *